US005111439A

United States Patent [19]

Erard

[11] Patent Number: 5,111,439

[45] Date of Patent: May 5, 1992

[54] CHRONOMETER WITH TIDE INDICATING MEANS

[76] Inventor: Raoul-Henri Erard, 4,rue de Chalet, 2301 La Chaux-De-Fonds, France

[21] Appl. No.: 532,699

[22] Filed: Jun. 4, 1990

[51] Int. Cl.[5] ..... G04B 19/26

[52] U.S. Cl. ..... 368/19

[58] Field of Search ..... 368/19, 15

[56] References Cited

U.S. PATENT DOCUMENTS 3,248,866 5/1966 Spilhaus ..... 368/19

4,623,259 11/1986 Oberst ..... 368/19

4,849,949 7/1989 Voth ..... 368/19

*Primary Examiner*—Bernard Roskoski

*Attorney, Agent, or Firm*—Young & Thompson

[57] ABSTRACT

A chronometer having a tide grid comprising a contour line indicating at least one complete tide cycle and a superposed reading grid comprising at least one read-off reference mark. One of the grids is driven in rotation at a constant angular speed about an axis. The grids are concentric about that axis and the read-off reference mark is radially disposed relative to that axis The contour line indicates tides on polar coordinates such that the distance of a point on the contour line from that axis indicates the height of the tide. The radial read-off reference mark intersects the contour line at a point which indicates the height of the tide for the time shown by the chronometer for a specific geographical location.

13 Claims, 5 Drawing Sheets

CHRONOMETER WITH TIDE INDICATING MEANS

BACKGROUND OF THE INVENTION

Some chronometers are known which give indications relating to the development of the tide for a specific location, this generally being done by means of needles or a disc moving at a constant speed and essentially giving indications on the situation of the tide in the course of time, without it being possible for exact indications about the level to be obtained. Moreover, some applications comprise mechanisms which take up considerable space and which use a fair amount of energy, unsuitable for use on a chronometer with quartz works.

Moreover, the chronometers known do not enable the development of the tide to be ascertained directly in nominal values of level in consideration of the specific values of the day under consideration, given in the tide directory for principal ports and secondary ports as well as, simultaneously, in consideration of some values concerning a secondary port of specific level situations for a particular predetermined location.

SUMMARY OF THE INVENTION

With a view to obviating these drawbacks, the present invention provides chronometer comprising a tide indicating means, characterised in that said tide indicating means is constituted, on the one hand, of a tide grid comprising at least one contour line of the semi-diurnal kind, in polar coordinates, and, on the other hand, a superposed, concentric reading grid comprising at least one radial read-off reference mark, one of the grids being constantly entrained by movement at a constant angular speed dependent on an average tide cycle, in such a way the the point of intersection between the contour line and the read-off reference mark constantly denotes the level of the tide and the tide time which correspond to the time shown by the chronometer for a specific geographical location.

DETAILED DESCRIPTION OF THE INVENTION

Figure 1:
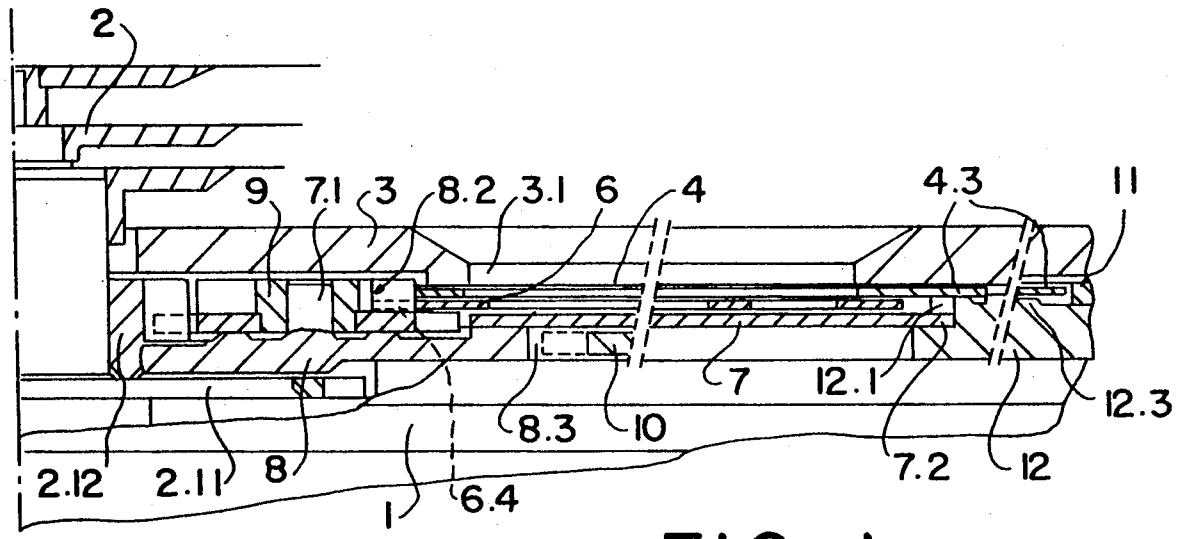
FIG. 1 and 2 show a first embodiment in section and in plan respectively.

In FIG. 1, the works 1(Quartz or mechanical) can be seen, the central needles 2 of which comprise the second, minute and hour needles. The face 3 comprises an extensive window for the tide indicating means 3.1. A tide pinion 2.12 which is in one part with the hours wheel 2.11 ensures, on the one hand, that a differential plate 8 pivots concentrically and is supported, on the one hand, and is kept immobile (by means of a friction device) when the peripheral tooth configuration thereof 8.3 is not entrained by the travel 10 of a manual corrector of the tide grid, and comprising a cylindrical core 8.2 around which a tide grid 6, adjusted by the inner tooth configuration 6.4 thereof, pivots concentrically, and, on the other hand, a satellite 9 is entrained at a constant speed synchronised to the hour hand, the satellite being constituted of a wheel which is fixed to a pinon which uses its inner tooth configuration to entrain the tide grid (in the opposite direction to the needles of the chronometer), in order that it may perform a precise rotation during a period of time which is equivalent to four average cycles of the tide, and this should be beneath the reading grid 4, adjusted concentrically by means of its peripheral tooth configuration 4.3 in a cylindrical housing 12.3 of the tide indicating means from 12 and kept immobile (by friction) when it is not entrained by the travel 11 of the manual corrector of the reading grid. A complementary face for the tide indicating means 7, disposed beneath grids in the area of the window of the tide indicating means is positioned by a stub 7.2 which is accommodated in a receiving means 12.1 of the frame in such a way that a reference mark for the tide indicating means which it carries is perfectly aligned on the vertical 12 hour axis.

When the average is taken of all tides between 1 January and 31 December, the tide directory (North Atlantic, reference Brest, year 1990 and following), gives a theoretical value of 12 h 25 min 18.47 secs for the average cycle of the tide. If the satellite is selected as the tide pinion and the inner tooth configuration of the tide grid has 16–10.8 and 53 teeth respectively, displacement of the tide grid is commanded between two successive high tide in 12 h 25 min 18.75 secs (the tide contour line comprising 4 cycles on a revolution), there being, after one operational year, a delay of 3 mins 17.4 secs for the high tide indicated by the tide contour line—this being a lower value than the exact reading.

The tide grids and the reading grids are designed with precision by photo-chemical engraving in the sheets of arcap which are about 0.05 mm in thickness, whereby very fine lines are able to be produced, and, since the grids are directly superposed, it is possible to reduce parallax error during a reading as much as possible. Ar cap is an alloy of 56 Cu, 25% N; 18% Zn and 0.3% Mn.

Figure 2:
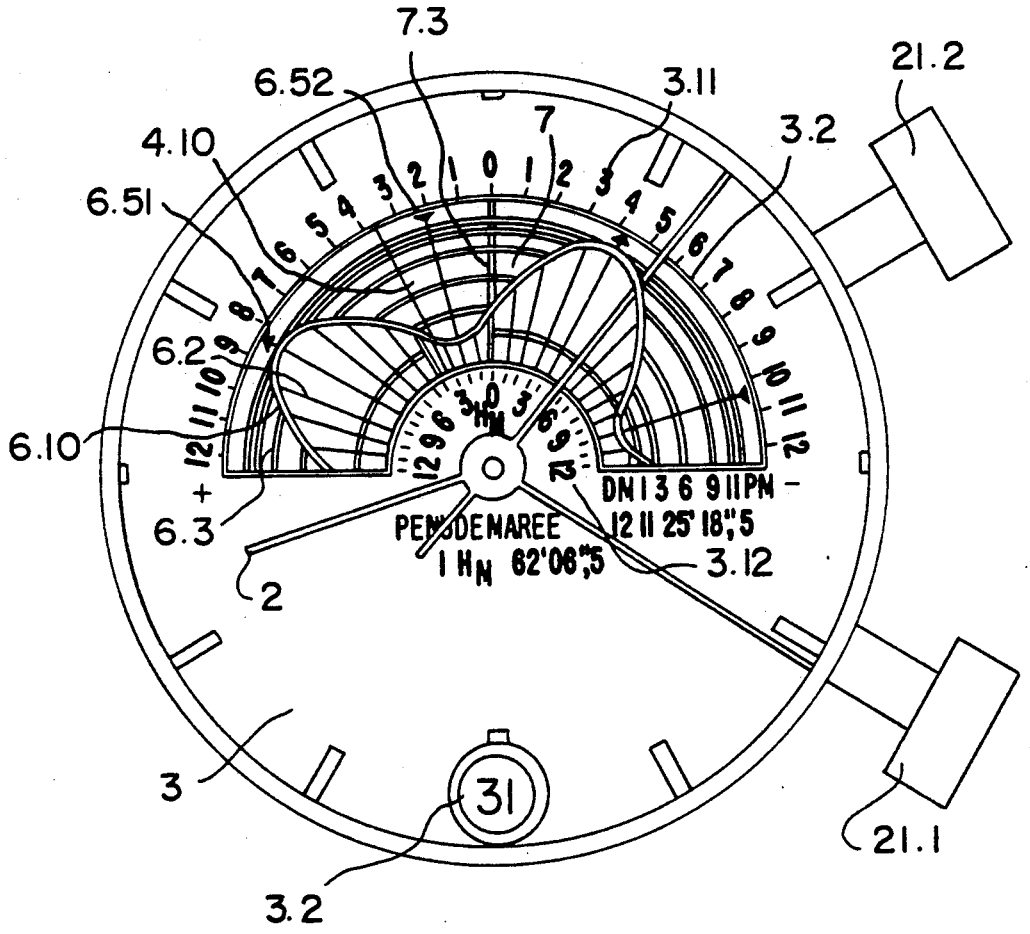

In FIG. 2, it is possible to see the group of needles 2 and the face 3, of which the window for the tide indicating means 3.1 gives the read-off reference mark 4.10 on the reading grid, the tide contour line 6.10 (half-day) which is in one piece with the segments of the contour line 6.3 corresponding to each tide time of 62 mins 06.5 secs (tide cycle divided by 12) which is marked radially by a tide time reference mark 6.2 and comprising high tide reference marks 6.51 and low tide reference marks 6.52, the bottom of the window being constituted by the face of the tide indicating means 7 which bears the reference mark for the tide indicating means 7.3, centered on the vertical axis (12 H) of the face and determining the origin of a "civil time" scale 3.11 on the outer circumference of the window, and of a "sea time" scale 3.12 beneath the inner circumference of the window, a window of a day of the month 3.2. The timing rim 21.1 can be displaced into an intermediate position in order that by manually rotating it in one direction, the day of the month can be set, and, by turning it in the other direction, the tide grid can be set, so that the tide contour line is adjusted in such a way that its intersection with the reference point corresponds to the situation defined by the tide directory for the reference location retained and for the hour and date (day of the month) indicated by the chronometer. The rim of the manual corrector of the reading grid 21.2 ensures, in a pulled position, that the reading reference mark is adjusted, so that it either gives indications which relate to a secondary port for which the tide development is displaced in time, or compensates the displacement which can exist between the reel period of the tide for a given day and the average period conditioning the displacement of the tide grid, if it is necessary to be particularly careful and accurate.

Figure 3:
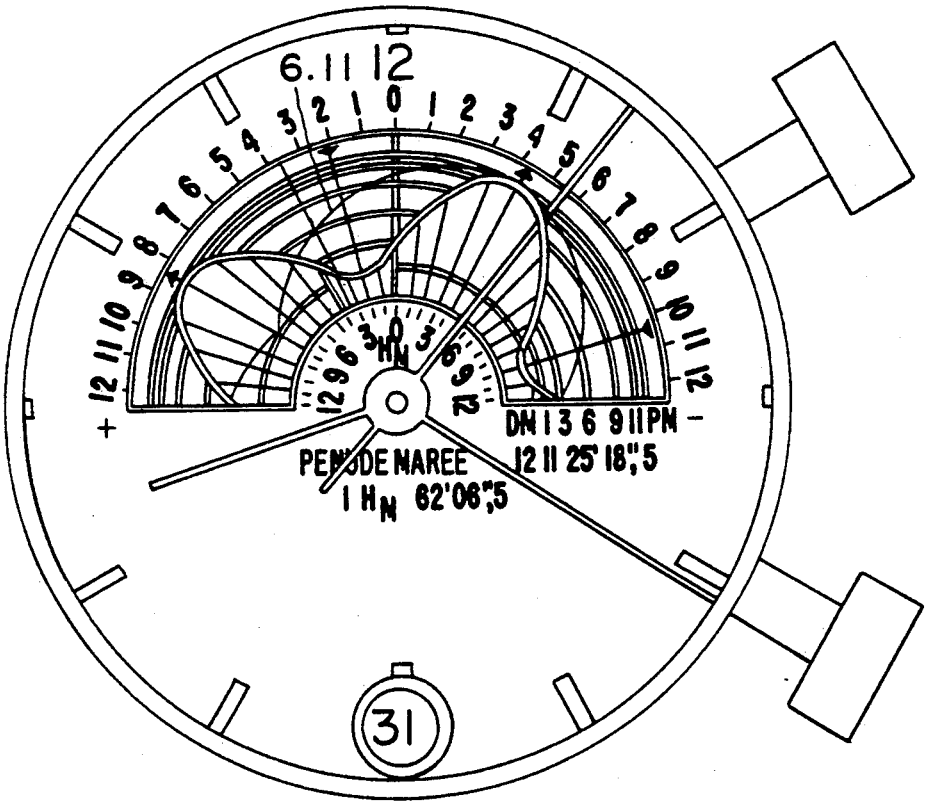
FIGS. 3 and 4 show, in plan, two complementary embodiments.

In FIG. 3, it is possible to see the means described in the first embodiments, and also, on the tide grid a complementary tide contour line of the diurnal kind 6.11 of the same amplitude as the semi-diurnal contour line, so as to permit an analysis to be made of the development of the tide in specific regions when there is a semi-diurnal tide or a mixed tide, and in this last instance, it is appropriate if the prime consideration is given to the specific regional character is referred to in the tide directory so as to carefully estimate the development of the level. It is possible, for zones which have a particular, well-defined, kind of tide to provide a specific tide contour line for these zones.

Figure 4:
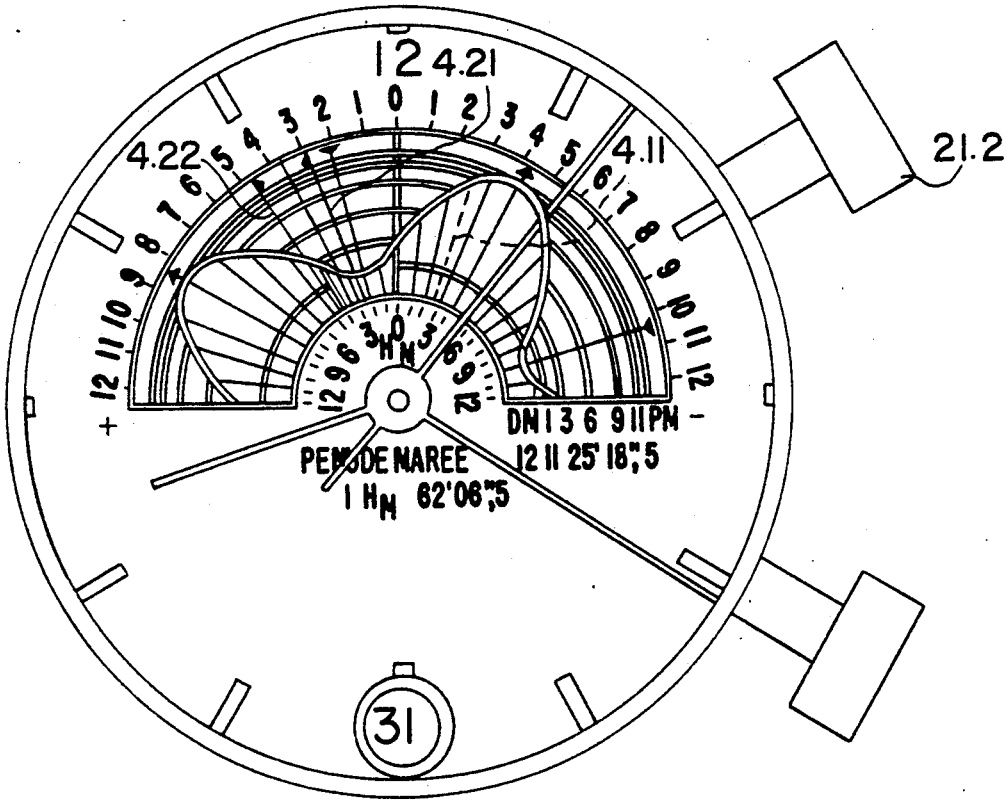

In FIG. 4, the means can be seen which are described in the first embodiment, and it is also possible to see a complementary read-off reference mark 4.11 which is displaced from by a half tide cycle in relation to the read-off reference mark such that it is possible, when this latter is in a position opposite a sector of the tide contour lie near low tide near the centre of the face, to estimate the position of the point of intersection with greater accuracy by using the complementary read-off reference mark opposite a sector of the tide contour line near high tide. Moreover specific supplementary read-off reference marks, input read-off reference marks 4.21 and output read-off reference marks 4.22 respectively, can be disposed independently of one another by activating the manual corrector of the reading grid 21.2 into separate positions activating each supplementary grid, in such a way that these reference marks delimit a specific period in relation to a specific situation of the tide level of the currents which it is producing. These reference marks can be disposed in relation to the reading reference mark so that when the high tide or low tide reference marks of the tide contour line cut them, a signal can be given that the period is one of a specific situation in relation to the high tide or low tide, or the reference marks can be disposed in relation to a specific point of the tide contour line defining a special situation.

It is possible to envisage a tide grid, the level contour line of which can be traced, at least partially, on an opaque rim comprising a window which enables complementary indications, dependent on time, to be read (for example, tide coefficient) appearing on a complementary rim which is coaxial and which rotates beneath the opaque rim at a relative speed which is particularly constant, and on the other hand, to place on one of the radial edges of the tide indicating means window a scale which relates to the tide level (for example at 1, 3, 6, 9, 11 twelfths of the tide level between low tide and high tide. It is also possible to envisage different scales relating to different nominal values (in meters) of the tide level.

In practice, the person using the chronometer is generally confronted with problems relating to the definition of the level as a function of time (above the point 0 of the sea charts) in of respect of the values of the high tide and of the low tide as a function of data and location.

Figure 5:
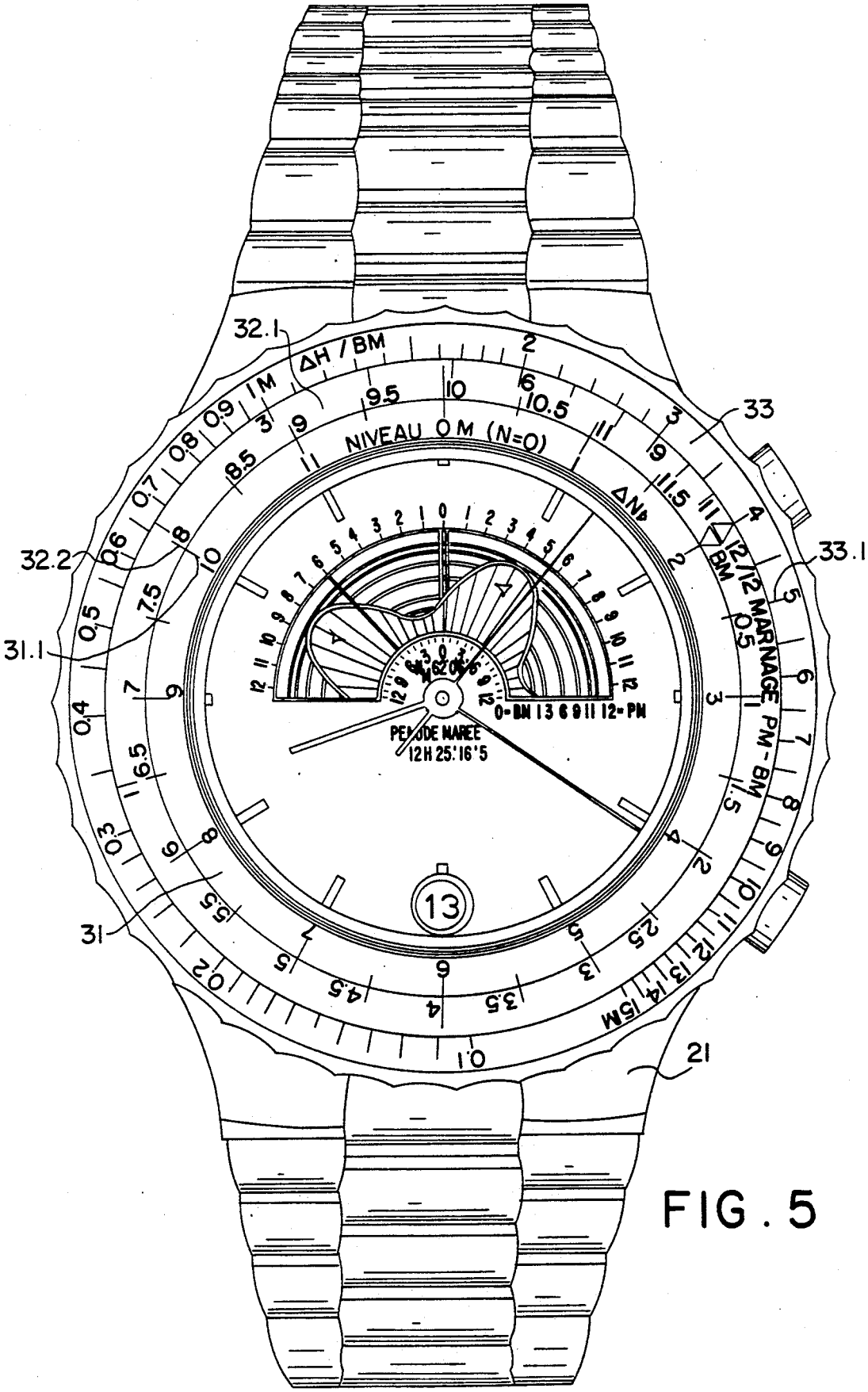
FIG. 5 shows first embodiment.

To this end, FIG. 5 shows the tide indicating means of the first embodiment and a box 21 comprising a rotating bezel which can be adjusted manually and which comprises an inner rim 31 which is in one piece with the box and which has a constant level scale 31.1 like the one 32.2, carried on the inside by a median rim 32 which is capable of rotating solely in the direction of the needles of the chronometer, so as to add and subtract levels, when it is entrained by the outer rim 33 which can also rotate in the opposite direction only in order to adjust the angular position of a logarithmical scale of "level difference" 33.1 which it carries opposite an identical scale 32.1, but graduated in 1/12 of the tide level (differences in level between high tide and low tide) corresponding to the different contour lines on the tide grid, this in relation to a position where the low tide originates which is valid for the two median scales.

If the values of the high tide and low tide shown in the tide directly are known, the relative position of the bezel simply needs to be adjusted as a function of these values, and it is then possible to immediately ascertain the development of the level of the sea (as a nominal value) during the cycle in question.

The tide grid can also comprises (for example, on the contour line for the high tide) reference marks denoting the times of the high tide which are useful for specifying currents which are occurring (the current charts are drawn up for each hour before or after high tide).

I claim:

1. A chronometer having the tide grid comprising a contour line indicating at least one complete tide cycle and a superposed reading grid comprising at least one read-off reference mark, one of said grids being driven in rotation at a constant angular speed about an axis, said grids being concentric about said axis and said read-off reference mark being radially disposed relative to said axis, said contour line indicating tides on polar coordinates such that the distance of a point on said contour line from said axis indicates the height of the tide, said radial read-off reference mark intersecting said contour line at a point which indicates the height of the tide for the time shown by the chronometer for a specific geographical location.

2. A chronometer according to claim 1, wherein said tide grid displays two fill tide cycles on said contour line.

3. A chronometer according to claim 1, wherein it is the tide grid that is rotated.

4. A chronometer according to claim 1, wherein the angular position of one of the grids at least can be modified by actuating a manual corrector.

5. A chronometer according to claim 1, wherein the tide grid respectively comprises radial reference marks specifying the different tide times, and segments of contour lines defining the different specific levels which correspond to said tide times.

6. A chronometer according to claim 1, wherein the reading grid comprises a complementary read-off reference mark which is displaced angularly by a half tide cycle in relation to the main read-off reference mark and which extends with respect to the contour line of the tide from half-tide to high-tide in such a way that when the main read-off reference mark is in a position where it is opposite a low tide sector of the contour line, it is possible to evaluate, with greater precision, the position of the point of intersection with the contour line by using the complementary read-off reference mark opposite the high tide sector of the same contour line.

7. A chronometer according to claim 1, which further comprises two specific supplementary read-off reference marks, an input read-off reference mark and an output read-off reference mark respectively, which can be disposed independently of each other in order to define a cycle in a specific situation, in relation to a particular point on the tide curve.

8. A chronometer according to claim 3, the tide grid comprising high tide reference marks and low tide reference marks making it possible to define, in relation to two separate read-off reference marks, each being fixed to a manually adjustable supplementary reading grid, the beginning and end of a period which defines a specific development in the level of the tide.

9. A chronometer according to claim 3, the tide grid comprising an inner tooth configuration by means of which it is adjusted, on the one hand, on the circumference of a cylindrical core of a differential gear plate which is kept immobile in a specific angular position which is capable of being modified by actuating a manual corrector, and, on the other hand, is entrained by a satellite pinion, itself entrained by a tide pinon fixed to a central shaft in one piece with the hour wheel entrained by movement and concentric to the needle.

10. A chronometer according to claim 3, wherein the contour line is traced, at least partially, on an opaque rim of the tide grid which comprises a display making it possible to read complementary markings, dependent on time, which appear on a complementary coaxial rim which rotates beneath the opaque rim at a specific speed which is constant in relation to the tide grid.

11. A chronometer according to claim 1, wherein the tide indicating means comprises two separate time scales, one for civil time, and the other for sea time.

12. A chronometer according to claim 1, which further comprises a rotating, manually adjustable bezel comprising specific reference marks opposite a scale in order that the level markings provided by the tide curve may be converted into nominal values determined in dependency on the amplitude of the tide for the day under consideration.

13. A chronometer according to claim 12, wherein the rotating bezel in constituted of three separate rotating rims, namely a fixed inner rim, a median rim which is capable of rotating solely in the direction of the needles of the chronometer when it is entrained jointly by an outer crown in such a way that it is possible, in a first operation, to displace an inner scale of the median rim opposite an identical scale on the fixed rim in order to add and subtract levels, and then, in a second operation, to displace the outer rim along in the opposite direction in order to displace an inner scale opposite an identical scale on the outside of the median rim in order to divide and multiply heights relating to the amplitude to the tide, the scales comprising reference marks which respectively relate to the high tide and low tide levels and to different levels corresponding to different contour lines of the tide indicating means.

* * * * *

UNITED STATES PATENT AND TRADEMARK OFFICE

CERTIFICATE OF CORRECTION

PATENT NO. : 5,111,439

DATED : May 5, 1992

INVENTOR(S) : Raoul-Henri ERARD

It is certified that error appears in the above—identified patent and that said Letters Patent is hereby corrected as shown below:

On the title page, under item [76] Inventor:, change "France" to --Switzerland--.

Signed and Sealed this

Tenth Day of August, 1993

*Attest:*

Michael K. Kirk

MICHAEL K. KIRK

*Attesting Officer*

*Acting Commissioner of Patents and Trademarks*